US011486564B2

(12) United States Patent
Baumeister et al.

(10) Patent No.: US 11,486,564 B2
(45) Date of Patent: Nov. 1, 2022

(54) LAMP COMPONENT COVERING A LIGHT SOURCE

(71) Applicant: BJB GmbH & Co. KG, Arnsberg (DE)

(72) Inventors: Olaf Baumeister, Sundern (DE); Philipp Henrici, Arnsberg (DE); Bastian Hunecke, Arnsberg (DE)

(73) Assignee: BJB GmbH & Co. KG, Arnsberg (DE)

( * ) Notice: Subject to any disclaimer, the term of this patent is extended or adjusted under 35 U.S.C. 154(b) by 74 days.

(21) Appl. No.: 17/026,179

(22) Filed: Sep. 19, 2020

(65) Prior Publication Data

US 2021/0131647 A1 May 6, 2021

(30) Foreign Application Priority Data

Nov. 4, 2019 (DE) ..... 102019129638.2

(51) Int. Cl.
*F21V 17/16* (2006.01)
*F21Y 115/10* (2016.01)

(52) U.S. Cl.
CPC ..... *F21V 17/164* (2013.01); *F21Y 2115/10* (2016.08)

(58) Field of Classification Search
CPC ..... F21V 17/164; F21Y 2115/10
See application file for complete search history.

(56) References Cited

U.S. PATENT DOCUMENTS 2,997,321 A * 8/1961 Bobrick ..... F21V 17/164 292/91
3,697,743 A * 10/1972 Eargle ..... F21V 17/164 362/260

FOREIGN PATENT DOCUMENTS

| | | | |
|---|---|---|---|
| CN | 107356731 | A | 11/2017 |
| CN | 108800068 | A | 11/2018 |
| DE | 19722005 | A1 | 12/1998 |
| DE | 202007013090 | U1 | 12/2007 |
| DE | 102007038788 | A1 | 2/2009 |
| DE | 202012003680 | U1 | 7/2012 |
| DE | 102012103439 | A1 | 10/2012 |
| DE | 202011051094 | U1 | 11/2012 |
| DE | 202014100952 | U1 | 6/2015 |
| DE | 102014112657 | A1 | 3/2016 |
| DE | 102018001189 | A1 | 8/2019 |
| EP | 3527888 | A1 | 8/2019 |
| WO | WO2014/184422 | A1 | 11/2014 |

* cited by examiner

*Primary Examiner* — Andrew J Coughlin
*Assistant Examiner* — Jessica M Apenteng
(74) *Attorney, Agent, or Firm* — Von Rohrscheidt Patents

(57) ABSTRACT

An optical light source cover configured to be fixed at a reaction bearing, the optical light source cover including an interlocking element configured to attach the optical light source cover at the reaction bearing, wherein the interlocking element includes an interlocking arm, wherein the interlocking arm extends from the optical light source cover in an insertion direction of the optical light source cover into the reaction bearing and includes a free end that is in front in the insertion direction and a connected end that is connected to the optical light source cover, wherein the interlocking element includes a first interlocking hook that is wedge shaped, wherein a first wedge tip of the first interlocking hook is oriented in a direction towards the free end of the interlocking element.

16 Claims, 7 Drawing Sheets

LAMP COMPONENT COVERING A LIGHT SOURCE

RELATED APPLICATIONS

This application claims priority from and incorporates by reference German patent application DE 10 2019 129 638.2, filed on Nov. 4, 2019.

FIELD OF THE INVENTION

The invention relates to a lamp component, in particular a cover for a light source like e.g. optics configured to be fixed at a reaction bearing, in particular a support plate, support profile, or cooling element including a fastening element configured to attach the lamp component at the reaction bearing.

BACKGROUND OF THE INVENTION

Generic lamp components, in particular configured as a cover for a light source configured as a light permeable synthetic material cover that influences an optical light distribution, generally designated as optics are known e.g., from WO2014/184422A1.

Typically synthetic materials like polycarbonate or polymethylmethacrylate are being used for covers of this type. Both synthetic materials can be produced to be transparent and light permeable and are very well suited to produce optical elements in the respective cover using an injection molding process. Using these optical elements it is possible to orient light that is radiated from a light source. This is required in particular for LED light sources.

Both synthetic materials, however, differ with respect to their elastic properties. Polycarbonate is a rather elastic material. Polymethylmethacrylate, however, is rather brittle therefore polycarbonate tends to go through a spring elastic deformation when put under load, whereas Polymethylmethacrylate rather tends to crack under pressure.

The properties of both synthetic materials are a reason that generic lamp components are attached at corresponding reaction bearings in lamp fabrication with separate fasteners like screws or interlocking pins in a separate fabrication step. This way it is assured that the covers are sufficiently fixed at the reaction bearing and that there are no fractures or deformations that lead to a disengagement of the lamp component from the reaction bearing.

The separate attachment step is disadvantageous from a fabrication point of view since a torque that impacts the lamp component has to be maintained within particular tolerances when using separate fasteners like screws or locking pins. Otherwise, the lamp component can be damaged during assembly. Measuring and limiting this torque is complex, in particular when fabrication is automated.

BRIEF SUMMARY OF THE INVENTION

Thus, it is an object of the invention to provide alternative attachment devices for generic lamp components, in particular covers for light sources, thus in particular optically effective covers that simplify fabrication and that are in particular compatible with material properties of the two synthetic materials described supra.

The object is achieved by a lamp component, in particular a cover for a light source like e.g. optics configured to be fixed at a reaction bearing, in particular a support plate, support profile or cooling element, the lamp component including an attachment element configured to attach the lamp component at the reaction bearing, wherein the attachment element is an interlocking element, wherein the interlocking element forms an interlocking arm, wherein the interlocking arm extends from the lamp component in an insertion direction and includes a free end that is in front in the insertion direction and a connected end that is connected to the lamp component, wherein the interlocking element includes a first wedge shaped interlocking hook, wherein a first wedge tip of the first wedge shaped interlocking hook is oriented in a direction towards the free end of the interlocking element, wherein a back surface that is oriented away from the first wedge tip and proximal to the lamp component functions as a support surface and forms an undercut of the first interlocking hook, wherein a side surface of the first interlocking hook is oriented at an angle to the insertion direction, wherein the first interlocking hook is supported in the interlocking element in a spring elastic and pivotable manner, and wherein the pivot axis of the first interlocking hook is arranged distal from the lamp component and proximal to the free end of the interlocking element.

First of all the invention uses interlocking elements configured as interlocking hooks to fix the lamp components, in particular optical light source covers for light sources which are in particular circuit boards with one or plural LEDs applied there to and configured as light sources. This substantially simplifies assembly since placement onto the reaction bearing and attachment at the action bearing is performed in one fabrication step.

It is a particular feature of interlocking elements, in particular of interlocking hooks arranged at the interlocking arm that the interlocking elements engage a suitable retaining contour, in particular a cutout in order to provide attachment at the reaction bearing and wherein the interlocking element performs an escapement movement about the support contour for this purpose. Thus, the interlocking element has to be elastically deformable in order to hook into the support contour. Therefore the interlocking arm typically deforms about an axis and performs a pivot movement about this axis.

The interlocking element according to the invention is provided with an interlocking hook wherein a pivot axis of the interlocking hook is arranged distal from the lamp component. Therefore the interlocking hook performs a pivot movement on a circular path and away from the lamp component when engaging the interlocking contour of the reaction bearing, wherein the center of a circular path coincides with the wedge tip. This particular position of the pivot axis of the first interlocking hook facilitates to adapt dimensions of the interlocking element to the tough and elastic polycarbonate and to the brittle polymethylmethacrylate. Thus, the position of the pivot axis of the first interlocking hook is an essential feature in order to fix optically effective covers made from the two synthetic materials recited supra at a reaction bearing using interlocking hooks, thus in a simple manner.

A lamp component is particularly advantageous that is characterized in that the interlocking arm includes a recess that is configured annular and closed by a bar on a side that is distal from the lamp component, wherein the first interlocking hook is arranged within the recess and connected to the bar, in particular when the pivot axis of the first interlocking hook is arranged in the portion of the attachment of the first interlocking hook at the bar, wherein the bar forms in particular the pivot axis of the first interlocking hook.

Supporting the interlocking hook in the recess described supra and connecting it to the interlocking arm facilitates an optimal tension distribution in the synthetic material when the interlocking arm is lifted over in order to engage the support contour of the reaction bearing.

When the interlocking arm is pivotable in a spring elastic manner about a pivot axis that is proximal to the lamp component the pivot movement that is required for lifting over the support contour can be distributed into two different material portions of the interlocking element, so that the tension is divided into two pivot or bending portions. This is another design feature that is configured to prevent permanent deformations through exceeding a reset elasticity of the rather tough elastic polycarbonate in order to prevent fractures caused by excessive tensions when using polymethylmethacrylate.

It is furthermore provided that the interlocking element includes a second interlocking hook, wherein a wedge tip of the second interlocking hook is also oriented in a direction towards the free end of the interlocking element, wherein a back surface that is oriented away from the wedge tip and that is proximal to the lamp component is also used as a support surface and forms an undercut of the second interlocking hook, wherein at least one side surface of the second interlocking hook is also oriented at an angle relative to the insertion direction, wherein the angle is oriented opposite to the angle of the first interlocking hook, so that the second interlocking hook is oriented opposite to the first interlocking hook, wherein the second interlocking hook is also supported spring elastic at the interlocking element, wherein the pivot axis of the second interlocking hook is arranged proximal to the lamp component and distal from the free end of the interlocking element. Thus, the pivot axis is distal from the wedge tip and proximal to the support surface, in particular between the support surface of the second interlocking hook and the lamp component.

Providing the second interlocking hook at the interlocking element facilitates adapting the same cover to different support contours of two reaction bearings that have at least different support contours. Thus, the same cover can be used for the reaction bearing in the first configuration and also for the reaction bearing in the second configuration.

Furthermore the second interlocking hook is arranged at an arm of the interlocking element outside of the recess.

In an advantageous embodiment the bar is part of the free end of the interlocking arm, in particular when the bar forms the wedge tip of the second interlocking hook and in particular also of the first interlocking hook.

When a pivot movement of the first and the second interlocking hook is counteracting when fixing the lamp component in the reaction bearing it is assured that the bending or pivot tension that is created during the lift over movement that is required for engaging the support contour is also dividable when two interlocking hooks are provided.

Furthermore the lamp component forms centering contours proximal to the interlocking element wherein the centering contours cooperate with a centering contour of the reaction bearing in order to arrange the lamp component in a correct position on the reaction bearing.

The support contours facilitate to fix the light source to be covered, thus in particular the circuit board that is provided with LEDs on the reaction bearing when applying and fixing the cover so that a separate attachment of the circuit board is not required.

Alternatively it is conceivable that the circuit board that is fixed at the reaction bearing before applying the cover to the reaction bearing receives additional contact pressure onto the reaction bearing from support structures of the lamp component. In particular when the circuit boards have larger dimensions even contact pressure over an entire circuit board surface is assured at the reaction bearing. Since the reaction bearing typically is a cooling element heat dissipation from the circuit board to the cooling element is optimized.

Furthermore, one of the two interlocking hooks fixes the lamp component in the reaction bearing by reaching behind the reaction bearing, whereas the other interlocking hook is configured to perform an anchoring function in that it is configured to support the interlocking element at the reaction bearing against a disengagement movement.

Using this feature of the invention the two interlocking hooks are not only used to fix the same optics optionally at one of two different reaction bearings. Additionally a respective interlocking hook that is not used for attachment is used for stabilization and support of the interlocking connection and improves the fixing of the lamp component under loads that work towards a disengagement of the interlocking connection.

Furthermore the support surface of the first interlocking hook advantageously has a surface that includes steps, a surface that is cambered or inclined in order to be able to compensate tolerances in material thickness of the reaction bearing.

It is also provided that the pivot axis of the interlocking arm and the pivot axis of the second interlocking hook coincide.

The object is also achieved by a reaction bearing which is characterized in that the reaction bearing includes a pass-through contour for the interlocking element, wherein a width of the pass-through contour is less than a width of the interlocking element that is defined by the undercuts of the first and the second interlocking hook.

In an advantageous embodiment the reaction bearing forms a support contour that cooperates with an interlocking hook in order to fix the lamp component at the reaction bearing and wherein the reaction bearing forms a support contour that cooperates with another interlocking hook in order to block a disengagement movement of the interlocking element that disengages the lamp component from the reaction bearing.

BRIEF DESCRIPTION OF THE DRAWINGS

The invention is now described based on an embodiment with references to figures, wherein.

DETAILED DESCRIPTION OF THE INVENTION

Figure 1:
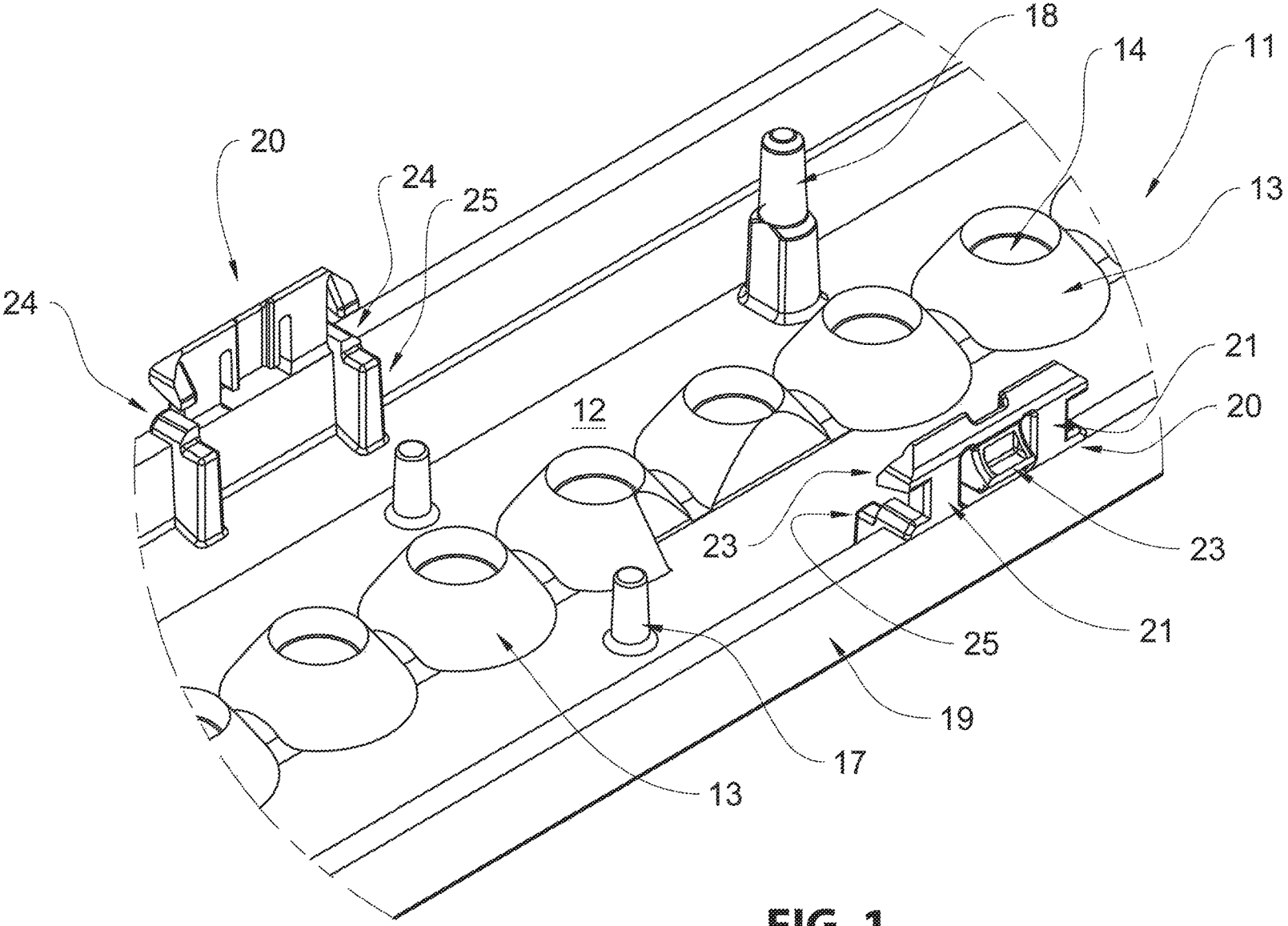
FIG. 1. illustrates a perspective partial view of a lamp component according to the invention showing a bottom side that is oriented towards the reaction bearing.

The drawing figures show an arrangement of the lamp component according to the invention and the reaction bearing overall designated of the reference numeral 10. The lamp component according to the invention is designated with the reference numeral 11.

The lamp component 11 illustrated in FIG. 1, is an optically effective cover made from transparent synthetic material like e.g. polycarbonate or polymethylmethacrylate. The lamp component includes a light exit wall 12 that includes a bottom side that is oriented towards the light source and towards a viewer of FIG. 1.

The light exit wall 12 includes optically effective elements 13 arranged at the bottom side and formed by the lamp component material itself. These are e.g. scatter or focal lenses including a receiving dish 14 that envelops a LED 15 of a LED circuit board illustrated in FIGS. 2 and 4. Support mandrels 17 support the LED circuit board 16 between themselves and a reaction bearing while assuring a uniform contact of the LED circuit board 16 at the reaction bearing. This assures good heat transfer between the circuit board 16 and the reaction bearing.

Centering pins 18 position the circuit board 16 relative to the optical elements 13 so that correct light control by the optical elements 13 is assured.

Side walls 19 off the optically effective cover 11 include interlocking elements that are designated overall by reference numeral 20 and an interlocking arm 21 that includes a first interlocking hook 22 and a second interlocking hook 23.

The side walls 19 form centering contours 24 in the portion of the interlocking elements 20 that are directly adjacent to the interlocking arm 21. The centering contours engage the support contour of the reaction bearing so that the cover 11 is correctly positioned relative to the reaction bearing. Support bars 25 are arranged in the portion of the interlocking elements 20 wherein the support bars contact the reaction bearing and stabilize the cover 11 in a portion of the interlocking elements that engage the support contour of the reaction bearing.

Figure 7:
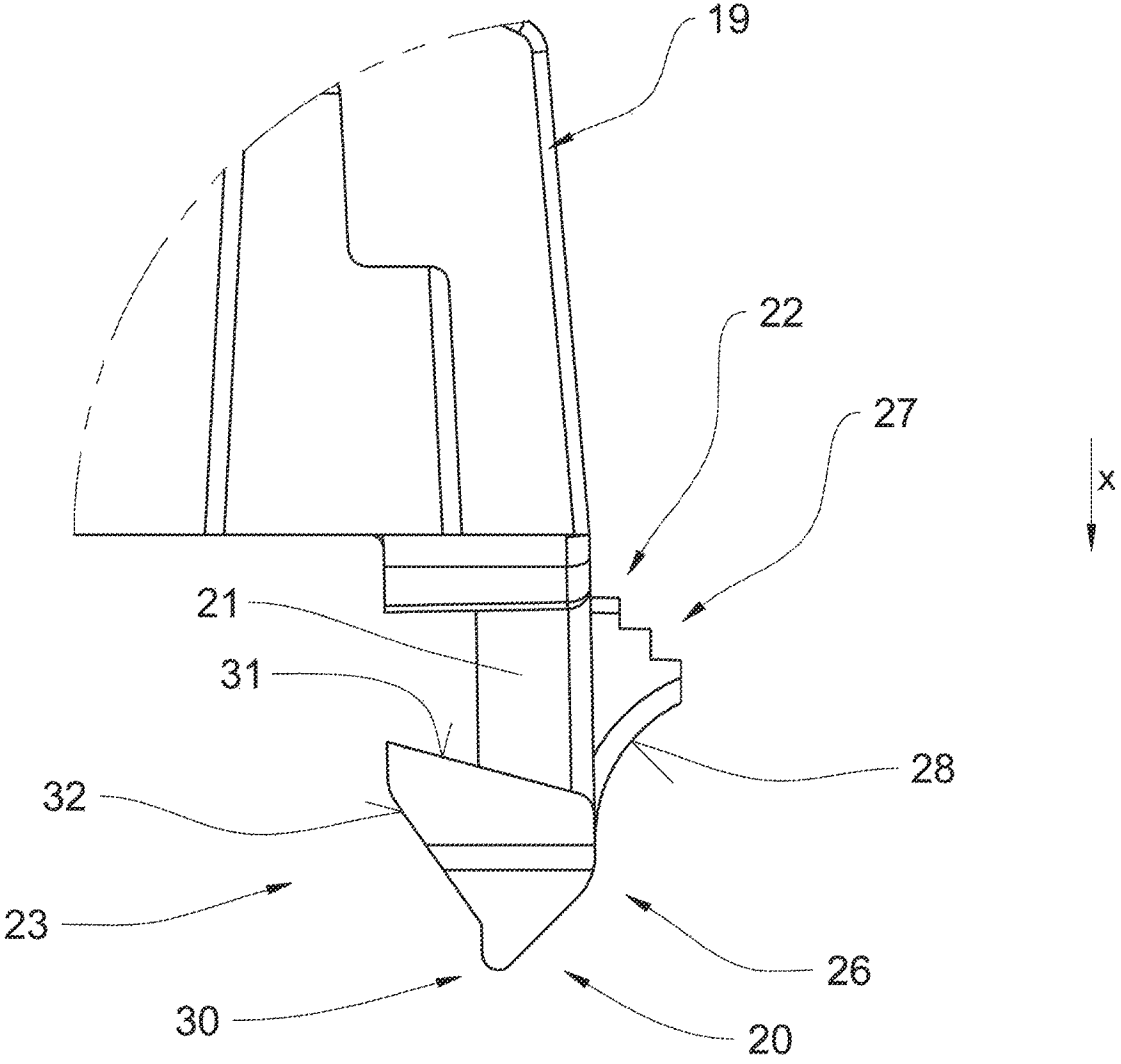
FIG. 7. illustrates the interlocking element according to FIG. 6 in a front view.

The illustration of FIG. 7 which shows a frontal view of the interlocking element 20 shows these features in detail. The interlocking element 20 included an interlocking arm 21 that extends from the lamp component in an insertion direction X and includes a free end and an end connected to the lamp component 11. The interlocking arm 21 supports a first interlocking hook 22 that is approximately wedge shaped. The first wedge tip 26 of the first interlocking hook is oriented towards the free end of the interlocking arm, whereas the first back surface 27 of the first interlocking hook 22 that is oriented away from the wedge tip is oriented in a direction towards the cover 11. The first back surface 27 functions as a support surface configured to attach the lamp component 11 at a reaction bearing. The interlocking hook further includes a first side surface 28 that extends from the first wedge tip 26 to the first back surface 27 and is oriented at an angle relative to the insertion direction. The first side surface is laterally deflected relative to the interlocking arm so that the first interlocking hook 22 is deflected in a first direction relative to the interlocking arm 21.

The first back surface 27 or the first support surface 27 includes a compensation structure configured to compensate various material thicknesses of a reaction bearing. In the illustrated embodiment the back surface is configured with steps and tapers from the interlocking arm in a deflection direction of the first interlocking hook 22. Alternatively this compensation structure can include a downward slanted surface or a cambered surface.

The interlocking arm 21 furthermore includes a second interlocking hook 23 with a second wedge tip 30 which is oriented in a direction towards a free end of the interlocking arm 21 or forms the free end of the interlocking arm 21 in this embodiment. The second interlocking hook 23 forms a second rear surface 31 that is oriented away from the second wedge tip 30 wherein the second rear surface 31 is also oriented towards the cover 11. A second side surface 32 of the wedge shaped second interlocking hook 23 extends from the second wedge tip 30 to the second back surface 31 and is inclined relative to the insertion direction X or the longitudinal extension of the interlocking arm 21, thus also oriented at an angle relative to the insertion direction. The angle that is defined between the second side surface 32 and the insertion direction X, however, has the opposite prefix and the same size as the angle enclosed between the first side surface and the insertion direction X, thus the second interlocking hook 23 is deflected at an opposite direction relative to the interlocking arm 21. Put differently the deflections of the first interlocking hook 22 and the second interlocking hook 23 are opposite.

Figure 6:
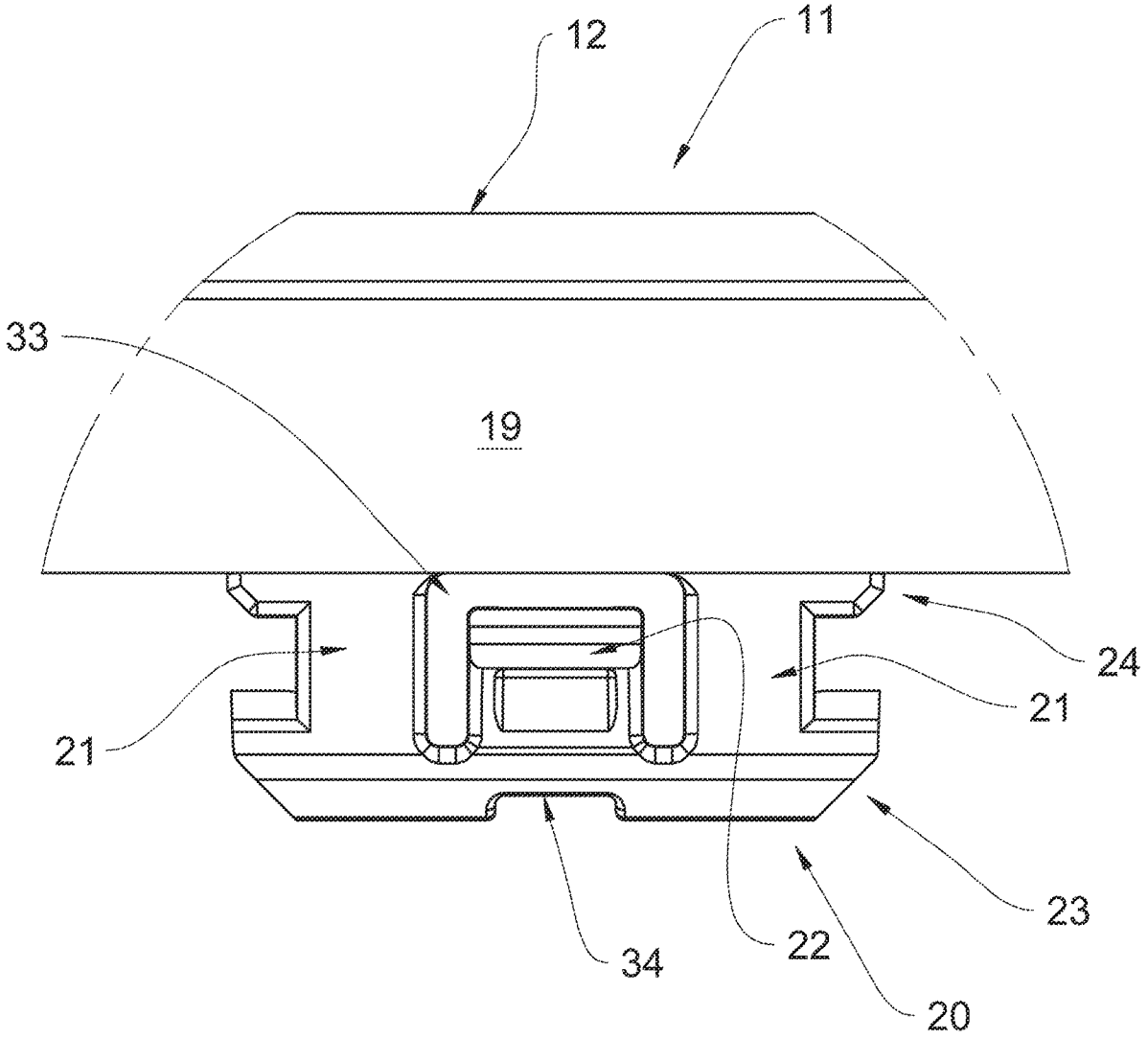
FIG. 6. illustrates a partial view of the lamp component according to the invention showing an interlocking element in a side view.

FIG. 6 illustrates a detail side view of the cover 11 showing the interlocking element 20. The interlocking arm 21 includes a recess 33 that is approximately annular, wherein the annular contour is approximately rectangular. The recess 33 is closed by an annular bar 34 at a side that is distal from the lamp component. By introducing the recess 33 into the interlocking arm 21, the interlocking arm 21 forms two interlocking arm supports that envelop the recess 33. The recess 33 is closed by the side wall 19 of the cover 19 on a side that is oriented away from the annular bar 34. The first interlocking hook 22 is arranged at the annular bar 34 so that the annular bar 34 forms the wedge tip 26 of the first interlocking hook 22. The annular bar 34 is part of the free interlocking arm and part of the second wedge tip 30. FIG. 6 illustrates that the annular bar 34 includes a zone of weakened material in the portion of the connection of the first interlocking hook 22.

The first interlocking hook 22 is arranged in a spring elastic pivotable manner at the interlocking arm 21 or in particular at an annular bar 34 of the interlocking arm 21. The first interlocking hook 22 can be pivoted back in a direction towards the interlocking arm 21 by a sufficient force application, e.g. when lifted over a support contour of the reaction bearing.

The pivot axis is in the connection portion of the annular bar 34 and the first interlocking hook 22, thus in the portion of the wedge tip 26 of the first interlocking hook 22 or is formed by the annular bar 34 in an advantageous embodiment. In order to assure a corresponding bending elasticity of the interlocking element material the annular bar 34 includes a zone where the material is weakened and that is illustrated in FIG. 6.

The second interlocking hook 23 that also includes a recess 33 or that is provided on both sides of the first interlocking hook 22 in a double configuration is also provided pivotable in a spring elastic manner in order to facilitate a lift over movement when engaging the support contour of the reaction bearing. A pivot axis of the second interlocking hook 23, however, is arranged in the connection portion of the interlocking arm 21 at the lamp component 11 or at its side wall 19 or corresponds to a pivot axis of the interlocking arm 21 which jointly preforms the lift over movement of the second interlocking hook 23 when engaging the support contour of a reaction bearing.

Thus, it becomes evident in view of FIGS. 6 and 7 that the pivot axis of the first interlocking hook is arranged distal from the lamp component, the pivot axis of the second interlocking hook, however, is arranged proximal to the lamp component. Furthermore FIG. 7 shows that a pivot movement of the interlocking hooks 22, 23 when engaging the support contour of the reaction bearing is performed in opposite directions due to the opposite deflection of the interlocking hooks 22, 23.

Figure 4:
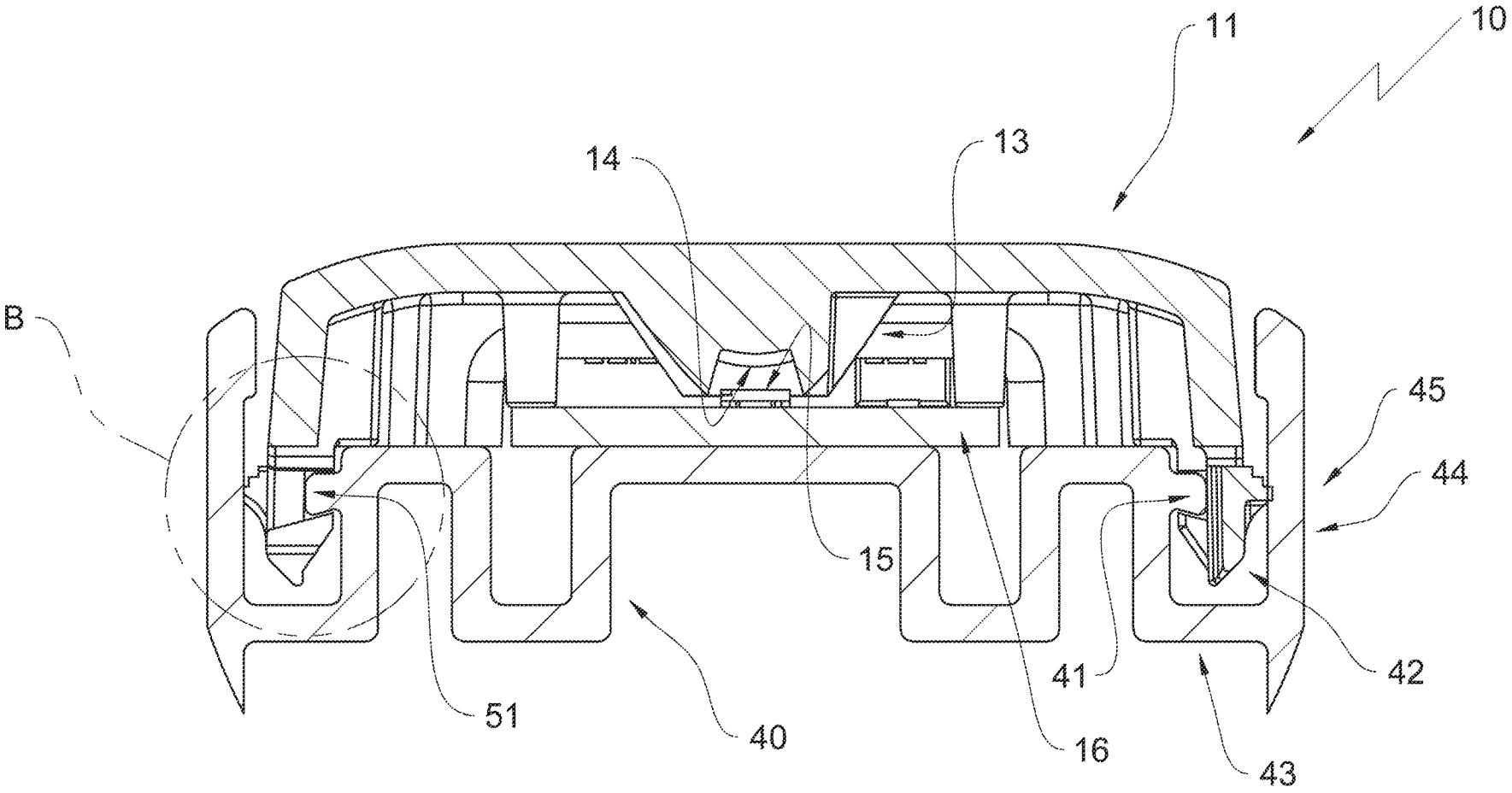
FIG. 4. illustrates the lamp component according to the invention arranged on a second embodiment of the reaction bearing in a cross sectional view.

FIG. 4. Illustrates the arrangement of the cover 11 according to the invention on a first embodiment of the reaction bearing 40 subsequently also designated as first reaction bearing 40. This is a highly profiled component on which a circuit board 16 with a LED 15 is arranged. The circuit board 16 and the LED 15 form a light source which is covered by the cover 11. Thus, the receiving dishes 14 of the optical elements 13 receive the LEDs 15.

The first reaction bearing 40 forms grip bars 41 that are oriented approximately parallel to the circuit board or protrude parallel to the light exit wall wherein the grip bars protrude into a groove cavity 42 of a profile groove 43. The groove wall that is arranged opposite to the grip bar 41 is configured as a support wall 44. Thus overall the profile groove 43 with the grip bar 41, the groove cavity 42 and the support wall 44 form the support contour 45 for fixing the cover 11 on the first reaction bearing 40.

Figure 5:
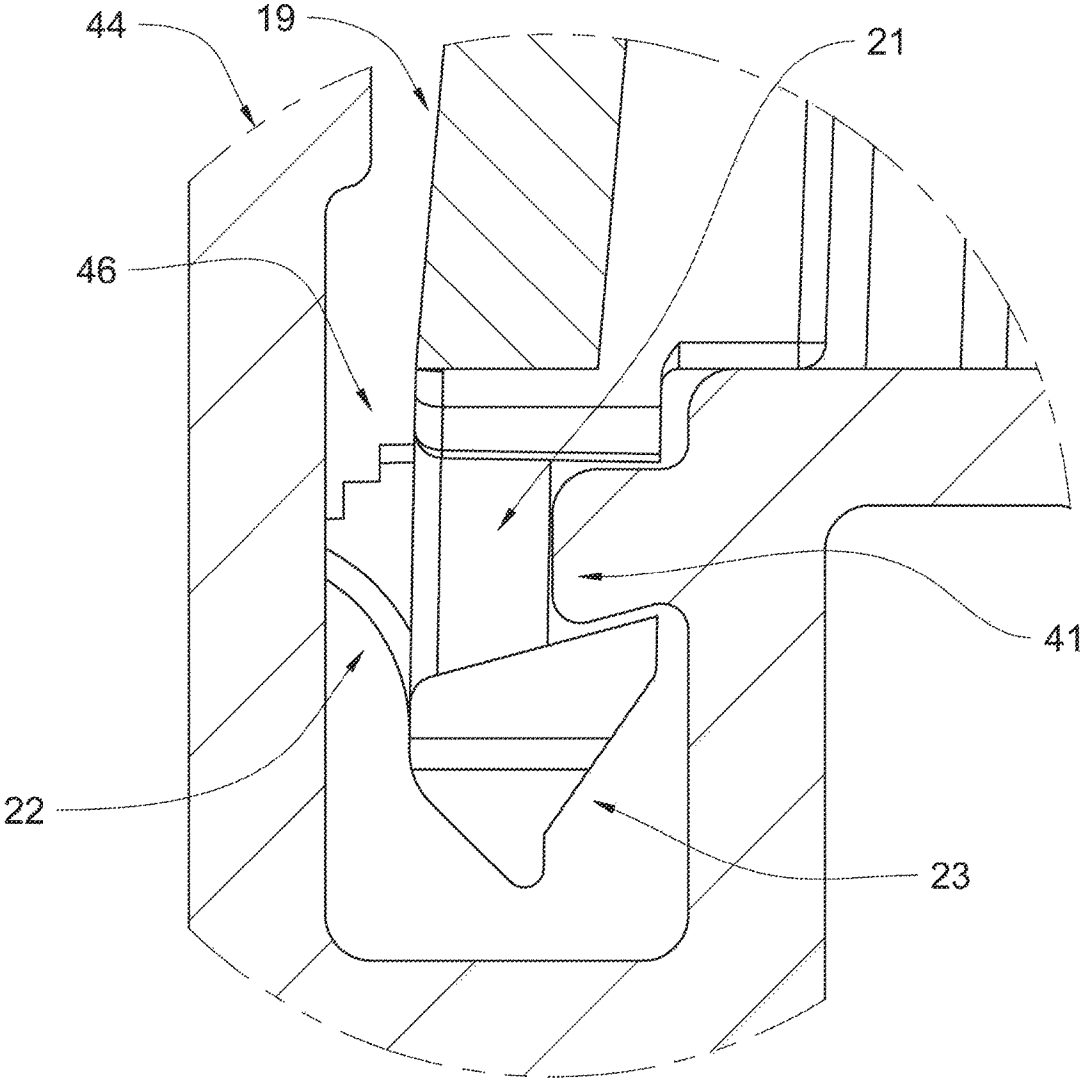
FIG. 5. illustrates detail B of FIG. 4.

It is evident from the blown up detail B illustrated in FIG. 5 that a pass-through opening 46 remains between the grip bar 41 and the support wall 44 wherein a width of the pass-through opening corresponds to a width of the second interlocking hook 23. In order to reach behind the grip bar 41 the interlocking hook 23, however, has to pivot outward in a direction towards the support wall 44 in order to perform a lift over movement over the grip bar 41. Thus, the interlocking hook 23 pivots about a pivot axis that is proximal to the side wall 19. Simultaneously, however, the first interlocking hook 22 is supported at the support wall 44. However, in order to perform the lift over movement the second interlocking hook 23 has to pivot in an opposite direction to the first interlocking hook 22 towards the interlocking arm 21. After the second interlocking hook 23 reaches behind the grip bar 41 the outward pivoted first interlocking hook 22 is supported at the support wall 44. This way the second interlocking hook 23 is supported in its fixing or attaching interlocking position, whereas the first interlocking hook 22 secures the interlocked position and is supported at the support wall 44.

Figure 2:
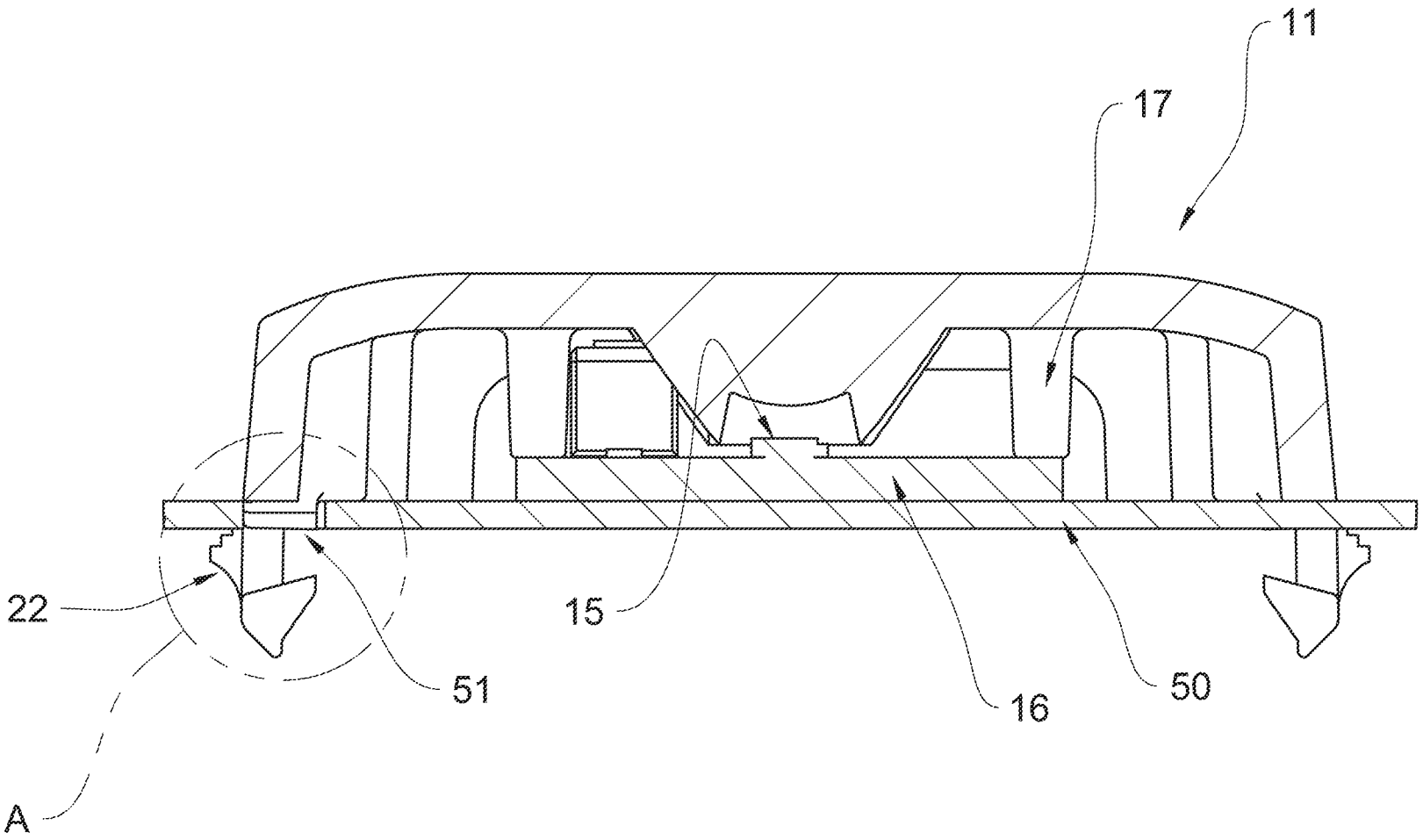
FIG. 2. illustrates a cross sectional view of the lamp component according to the invention arranged on a first embodiment of the reaction bearing.

FIG. 2. Illustrates the fixation of the cover 11 at a second reaction bearing 50 with a different configuration. This is an essentially flat component, e.g., a piece of sheet metal on which the circuit board 16 with the LEDs 15 arranged thereon is placed which is enveloped by the lamp component 11. The reaction bearing 50 includes a cutout 51, wherein edges of the cutout form the support contour and cooperate with the first interlocking hook 22 in order to fix the cover 11 at the reaction bearing 50. The detail view showing detail A in FIG. 2 Illustrates that a width of the pass-through opening corresponds approximately to a width of the first interlocking element 22 and that the first interlocking element 22 has to be pivoted through the pass through opening 51 towards the interlocking arm 20 in order to perform the passage. Only this way the required lift over movement of the first interlocking hook 21 can be performed when moving through the pass-through opening 51. Thus, the first interlocking hook 22 pivots around a pivot axis that is remote from the lamp component and that is arranged in a portion of the free end of the interlocking arm 21. Additionally the interlocking arm 21 can be moved about a pivot axis that is proximal to the lamp component which is advantageous for brittle synthetic materials so that the total lift over movement for inserting the interlocking element 20 into the pass-through opening 51 can be divided between the interlocking arm 21 and the first interlocking hook 22. Thus, the required forces can be distributed over the interlocking element 20 so that overload torques in individuals portions are avoided.

Figure 3:
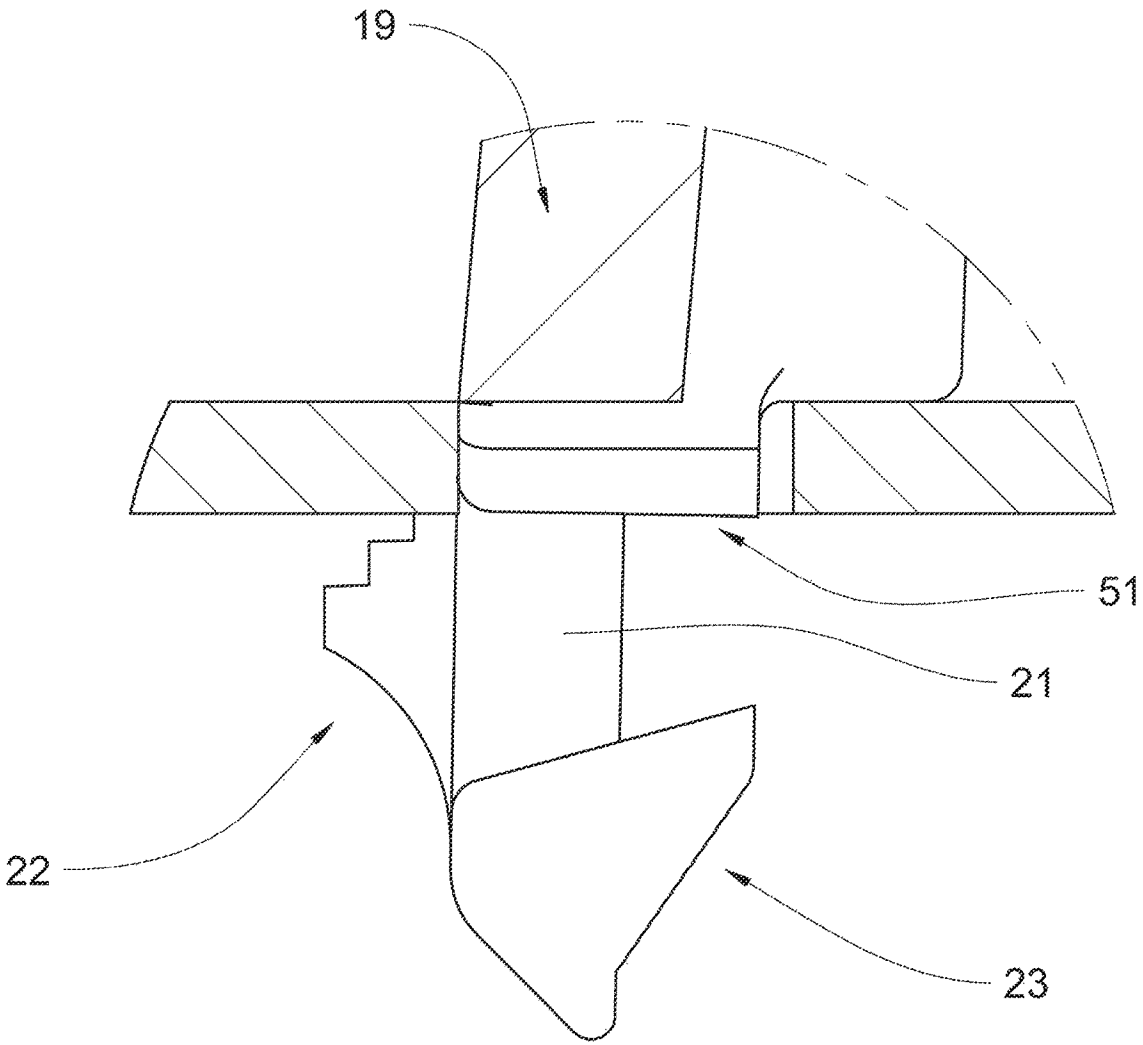
FIG. 3. illustrates a view of detail A of FIG. 2.

FIG. 3 furthermore illustrates an advantage of the compensation contour of the first interlocking hook 22. The first interlocking hook 22 can reach behind different thicknesses of reaction bearings and sheet metal due to its step contour so that a secure positioning of the cover 11 is assured on the second reaction bearing 50.

Also when fixing the lamp component 11 at the second reaction bearing 50 the non-used second interlocking hook 23 secures against disengagement. When tension forces or disengaging forces impact the lamp component 11 the interlocking element is reliably supported at the reaction bearing 50 by the first interlocking hook having a pivot axis that is distal from the lamp component. An imaginary disengagement movement of the cover 11 away from the reaction bearing 50 does not cause an inward pivoting of the first interlocking hook 22 but further outward pivoting and thus wedging due to the position of the pivot axis. Therefore this way the axis of the first interlocking element being positioned distal from the lamp component has a substantial advantage for securing the attachment. Increasing the disengagement forces upon the lamp component 11 would now lead to an inward pivoting of the second interlocking hook 23 or the interlocking arm 21 about a pivot axis that is proximal to the lamp component which causes the second interlocking hook 23 to contact the edge of the pass through opening 51 that is oriented away from the first interlocking hook 22. This way the interlocking hooks 22 and 23 stabilize each other when the lamp component 11 is fixed on the second reaction bearing 50 and thus reliably secure the cover 11 on the reaction bearing 50.

REFERENCES NUMERALS AND DESIGNATIONS

10 Arrangement of Lamp Component and Reaction Bearing
11 Lamp Component/Cover
12 Light Exit Wall
13 Optically Effective Elements
14 Receiving Dish
15 LED
16 LED Circuit Board
17 Support Mandrel
18 Centering Pin
19 Side Wall
20 Interlocking Element
21 Interlocking Arm
22 First Interlocking Hook
23 Second Interlocking Hook
24 Centering Contour
25 Support Bar
26 First Wedge Tip
27 First Back Surface
28 First Side Surface
30 Second Wedge Tip
31 Second Back Surface
32 Second Side Surface
33 Recess
34 Annular Bar
40 First Reaction Bearing
41 Grip Bar
42 Groove Cavity
43 Profile Groove

44 Support Wall
45 Support Contour
46 Pass-through Opening
50 Second Reaction Bearing
X Insertion Direction

What is claimed is:

1. An optical light source cover configured to be fixed at a reaction bearing, the optical light source cover comprising:

an interlocking element configured to attach the optical light source cover at the reaction bearing, wherein the interlocking element includes an interlocking arm, wherein the interlocking arm extends from the optical light source cover in an insertion direction of the optical light source cover into the reaction bearing and includes a free end that is in front in the insertion direction and a connected end that is connected to the optical light source cover, wherein the interlocking element includes a first interlocking hook that is wedge shaped, wherein a first wedge tip of the first interlocking hook is oriented in a direction towards the free end of the interlocking element, wherein a back surface of the first interlocking hook that is oriented away from the first wedge tip and proximal to the optical light source cover is not in contact with the reaction bearing and forms a support surface with undercut at the first interlocking hook, wherein a side surface of the first interlocking hook that is in front in the insertion direction is oriented at an angle relative to the insertion direction and is not in contact with the reaction bearing, wherein the first interlocking hook is formed integrally in one piece with the interlocking element and pivotable relative to the interlocking element in a spring elastic manner, and wherein a pivot axis of the first interlocking hook is arranged distal from a light exit surface of the optical light source cover and proximal to the free end of the interlocking element that pivots about the pivot axis.

2. The optical light source cover according to claim 1, wherein the interlocking arm includes an annular recess that is closed by a bar that is distal from the light exit surface, and wherein the first interlocking hook is arranged within the annular recess and integrally formed in one piece with the bar.

3. The optical light source cover according to claim 2, wherein the pivot axis of the first interlocking hook is arranged in a portion where the first interlocking hook is joined at the bar, and wherein the bar forms the pivot axis of the first interlocking hook.

4. The optical light source cover according to claim 2, wherein the interlocking element includes a second interlocking hook, wherein a wedge tip of the second interlocking hook is also oriented in a direction towards the free end of the interlocking element, wherein a back surface of the second interlocking hook that is oriented away from the second wedge tip and that is proximal to the optical light source cover also functions as a support surface and forms an undercut of the second interlocking hook, wherein a side surface of the second interlocking hook is oriented at an angle relative to the insertion direction X but deflected in a direction that is opposite to a deflection direction of the first interlocking hook, so that the second interlocking hook is deflected in an opposite direction relative to the first interlocking hook, wherein the second interlocking hook is formed integrally in one piece with the interlocking element and pivotable relative to the interlocking element in a spring elastic manner, and wherein a pivot axis of the second interlocking hook is arranged proximal to the optical light source cover and distal from the free end of the interlocking element.

5. The optical light source cover according to claim 4 wherein the second interlocking hook is arranged at the interlocking arm of the interlocking element outside of the annular recess.

6. The optical light source cover according claim 5 wherein the bar forms part of the free end of the interlocking arm.

7. The optical light source cover according to claim 5, wherein the bar forms the first wedge tip of the first interlocking hook and the second wedge tip of the second interlocking hook.

8. The optical light source cover according to claim 4, wherein pivot movements of the first interlocking hook and the second interlocking hook during fixing of the optical light source cover in the reaction bearing are opposite to one another.

9. The optical light source cover according to claim 4, wherein one of the first interlocking hook and the second interlocking, hook fixes the optical light source cover in the reaction bearing by reaching behind the reaction bearing, whereas another of the first interlocking hook and the second interlocking hook secures an anchoring function in that the other interlocking hook supports the interlocking element against a disengagement movement at the reaction bearing.

10. The optical light source cover according to claim 4, wherein the interlocking arm is configured to pivot in a spring elastic manner about a pivot axis that is proximal to the optical light source cover, and wherein the pivot axis of the interlocking arm and the pivot axis of the second interlocking hook coincide.

11. The reaction bearing for the optical light source cover according to claim 4, wherein the reaction bearing includes a pass-through contour for the interlocking element, wherein a width of the pass-through contour is lees than a width of the interlocking element that is defined by the undercut of the first interlocking hook and the undercut of the second interlocking hook.

12. The reaction bearing according to claim 11, wherein the reaction bearing forms a support contour that cooperates with one of the first interlocking hook and the second interlocking hook so as to fix the optical light source cover at the reaction bearing, wherein the reaction bearing forms a support contour that cooperates with another of the first interlocking hook and the second interlocking hook so as to block a disengagement movement of the interlocking element wherein the disengagement movement disengages the fixing of the optical light source cover at the reaction bearing.

13. The optical light source cover according claim 2, wherein the reaction bearing includes a first reaction bearing and a second reaction bearing, wherein the first interlocking hook is adapted to an attachment contour of a first reaction bearing and the second interlocking hook is adapted to an attachment contour of a second reaction bearing, and wherein a geometric configuration of the first reaction baring differs from a configuration of the second reaction bearing.

14. The optical light source cover according to claim 1, wherein the optical light source cover forms centering contours proximal to the interlocking element, and wherein the centering contours cooperate with a centering contour of the reaction bearing so that the optical light source cover is correctly positioned on the reaction bearing.

15. The optical light source cover according to claim 1, wherein the back surface of the first interlocking hook includes a cambered or sloped surface with steps configured to compensate for tolerances of a material thickness of the reaction bearing.

16. The optical light source cover according to claim 1, wherein the interlocking arm is configured to pivot in a spring elastic manner about a pivot axis that is proximal to the optical tight source cover.

* * * * *